US006369524B2

(12) United States Patent
Sid

(10) Patent No.: US 6,369,524 B2
(45) Date of Patent: Apr. 9, 2002

(54) ADDRESSABLE LIGHT DIMMER AND ADDRESSING SYSTEM

(75) Inventor: Alberto Sid, Upper Saddle River, NJ (US)

(73) Assignee: MAF Technologies Corp., New Milford, NJ (US)

( * ) Notice: Subject to any disclaimer, the term of this patent is extended or adjusted under 35 U.S.C. 154(b) by 0 days.

(21) Appl. No.: 09/736,832

(22) Filed: Dec. 14, 2000

Related U.S. Application Data

(63) Continuation-in-part of application No. 09/259,019, filed on Feb. 26, 1999, now Pat. No. 6,175,201.

(51) Int. Cl.[7] ..... G05F 1/00

(52) U.S. Cl. ..... 315/292; 315/293; 315/312; 315/314; 315/316

(58) Field of Search ..... 315/292, 293, 315/295, 312, 314, 316, 324

(56) References Cited

U.S. PATENT DOCUMENTS 4,392,187 A * 7/1983 Bornhorst ..... 362/233
4,947,302 A * 8/1990 Callahan ..... 362/233
4,980,806 A * 12/1990 Taylor et al. ..... 362/85
5,059,871 A * 10/1991 Pearlman et al. ..... 315/316
5,072,216 A * 12/1991 Grange ..... 340/825.52
5,245,705 A * 9/1993 Swaney ..... 395/200
5,352,957 A * 10/1994 Werner ..... 315/291
5,406,176 A * 4/1995 Sugden ..... 315/292
5,530,332 A * 6/1996 Rees ..... 318/685
6,031,343 A * 2/2000 Recknagel et al. ..... 315/292
6,188,181 B1 * 2/2001 Sinha et al. ..... 315/293
6,236,170 B1 * 5/2001 de Leijer ..... 315/316

* cited by examiner

*Primary Examiner*—Don Wong
*Assistant Examiner*—Tuyet T. Vo
(74) *Attorney, Agent, or Firm*—Notaro & Michalos P.C.

(57) ABSTRACT

An addressable lighting device and control system uses a DMX-512 protocol controller or other serial network protocol controller to selectively generate an electronic address for the addressable lighting device on which the device will respond to all future signals from the controller corresponding to that electronic address. The addressable device has a program mode for setting the address and a working mode for receiving control signals on the set address. The addressable device may have the address set and changed remotely using the DMX-512 protocol controller and a remote control to switch modes, thereby avoiding the problems associated with using DIP switches to set device electronic addresses.

36 Claims, 5 Drawing Sheets

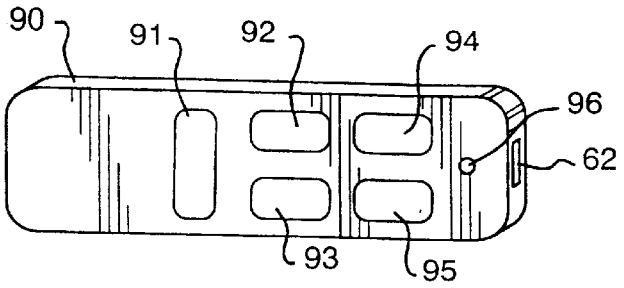
FIG. 3
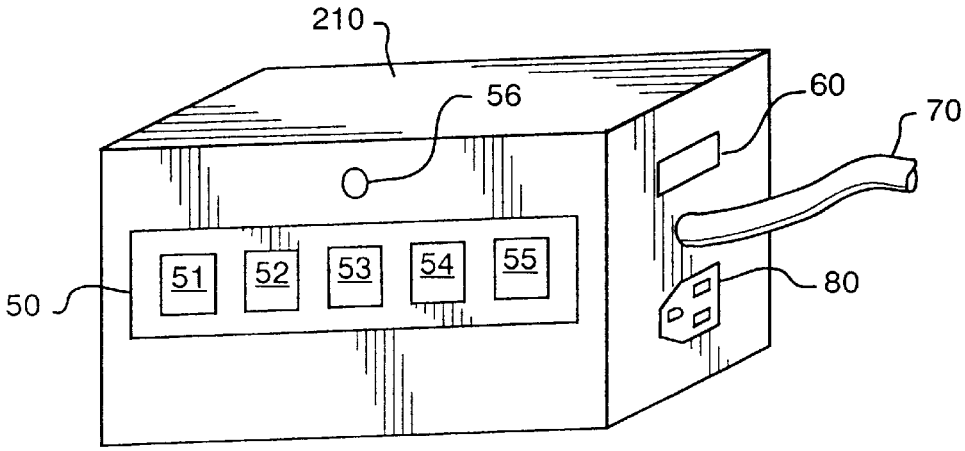
FIG. 4
FIG. 5
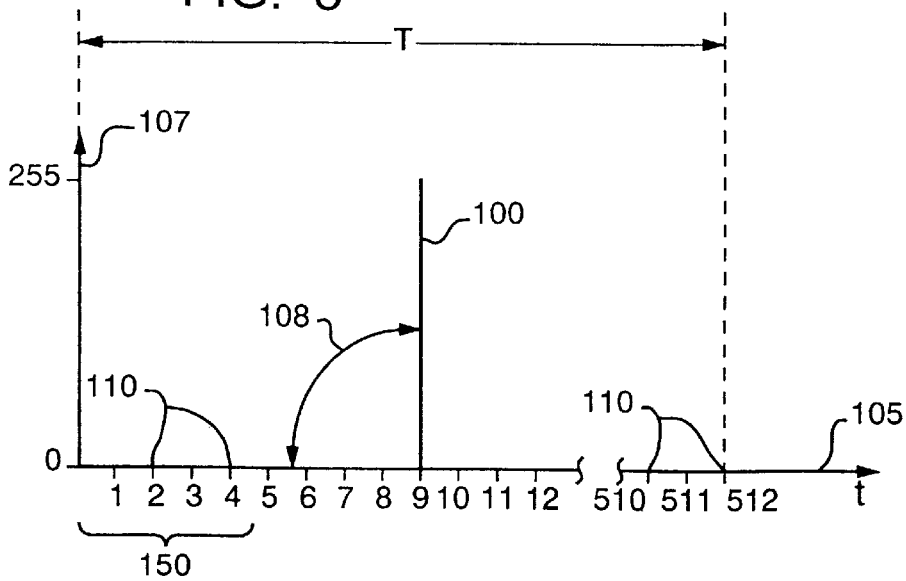

ADDRESSABLE LIGHT DIMMER AND ADDRESSING SYSTEM

CROSS-REFERENCE TO RELATED APPLICATIONS

This application is a continuation-in-part application of Ser. No. 09/259,019, filed Feb. 26, 1999, now U.S. Pat. No. 6,175,201.

FIELD AND BACKGROUND OF THE INVENTION

The present invention relates generally to the field of control systems for lighting devices and in particular to a new and useful electronically addressable device and DMX-512 protocol addressing system for the device.

Theater lighting systems used in stage productions are often elaborate and include many different lighting devices and effects devices to produce a desired lighting combination. In recent years, many different aspects of lighting systems have been computerized to improve the ease and speed with which a lighting program for a particular stage show can be set up. While many different control systems are available for this purpose, one protocol which is generally accepted for use in theater lighting in particular is the DMX-512 protocol. DMX-512 protocol refers to a protocol standard as defined by the United States Institute for Theatre Technology, Inc. (USITT).

Presently, a DMX-512 protocol controller has up to 512 channels transmitted serially to each of any number of connected lighting system devices. Known devices each contain a manually set address circuit which identifies the particular channel or channels that the device will take instructions from the DMX-512 controller. Each of the DMX-512 controller channels has multiple levels, or amplitude settings, to produce different conditions in the connected lighting devices, whether they be dimmers, color mixers, etc. The DMX-512 controller does not produce a digital signal; that is, a binary address cannot be programmed on any one of the DMX-512 controller channels.

A drawback to the known lighting devices used with DMX-512 protocol systems is that the addresses of the devices must be set manually using DIP switches by a person having physical contact with the device. In order to change the address of a particular device, the DIP switches must be reset in the proper configuration for the new address.

When the lighting devices have been mounted on fly rods many feet above a theater stage, this can present a problem. Either the entire fly rod must be lowered to the level of the stage or a stage hand must climb up to the position of the lighting device. When the lighting devices are not mounted on movable theater equipment, but rather in a fixed spot this difficulty is increased. The address switches may be obstructed by other objects as well, including the mounting brackets for the lighting device, further increasing the difficulty of changing the address of a device.

The DMX-512 protocol control system is discussed in connection with the lighting system taught by U.S. Pat. No. 4,947,302. The lighting system is programmable with intensity changes, movements, etc., but the addresses of the lamps and other devices are not programmable.

Other types of lighting systems with digitally addressable devices are known.

For example, a lighting system with programmable addressable dimmers is taught by U.S. Pat. No. 5,530,332, which discusses the problems associated with manually set addressable dimmers and teaches a dimmer which is addressed by first entering a program mode by depressing buttons. An address is then set in the dimmer memory by using a central controller to generate the address location data and send the address to the dimmer. The address location data is a binary word.

U.S. Pat. No. 5,059,871 teaches a lighting system in which individual lamp controllers may have their addresses programmed electronically from a central controller unit. When one of the lamp controllers is placed in a programming mode, a Master Control Unit (MCU) in the central controller unit is used to generate an identification (ID) for the lamp controller. The particular ID is set by incrementing or decrementing any channel on the central controller between 1 and 31. The ID value is shown in binary code on a LED display. The ID in the lamp controller is the address used to select the lamp(s) connected to the lamp controller. The lamp controller may be a dimmer or on/off switch, for example.

A control system with programmable receivers for controlling appliances is disclosed by U.S. Pat. No. 5,352,957. The receivers may control lights, for example. The original addresses for the controlling receivers are initially set manually, but may be changed electronically once the receivers are connected to the control system. The addresses of the receivers are set automatically based on their positioning within the system, rather than by a person on an arbitrary basis.

U.S. Pat. No. 5,245,705 discloses a memory addressing system in which a central control unit sends a message signal with an address code to several attached devices over a bus interface. Devices which are encoded to accept the address code respond to the message signal. At column 6, lines 3–8, this patent indicates that the functional addresses recognized by a device may be changed using a control message. The memory addressing system is not specifically for a lighting system, but rather, is for use in a general data processing system.

Lighting systems using addressable lamps controlled by computers are also known in the prior art.

U.S. Pat. No. 5,406,176 teaches a lighting system controlled by a personal computer. The computer can address individual lamps which have pre-programmed addresses. However, changing the addresses of the lamps using the computer is not taught.

U.S. Pat. No. 4,392,187 discloses a console-controlled lighting system having addressable lights of the manual set type. The electronic address of each light is set using manual thumb switches. The console sends instructions which are interpreted by the light to which they are addressed.

A series of lighting cues can be programmed and stored in memory in each lamp of the lighting system disclosed by U.S. Pat. No. 4,980,806. The different lighting cues, or setups, can be recalled by a signal sent from a central controller. The electronic addresses of the individual lamps are not changed using the controller.

U.S. Pat. No. 5,072,216 discloses a track lighting system having individual lights with manually set address switches contained in the light housings.

None of these prior systems provides a method or system for using a DMX-512 protocol controller to remotely change or set the address of devices connected to the controller.

SUMMARY OF THE INVENTION

It is an object of the present invention to provide an electronically addressable device that can be used with a serial network control system and the address of the device can be set remotely using a central controller.

It is a further object of the invention to provide a method for using a DMX-512 protocol or other serial network protocol controller to remotely set the addresses of any number of connected devices.

Yet another object of the invention is to provide a method for remotely setting threshold and other preset values in one or more devices connected to a central controller using DMX-512 or other serial network control protocols.

Accordingly, the invention has a central controller, or code generating, system having a fixed number of control channels with at least one channel connected to an addressable device to be controlled, such as an addressable light dimmer. Multiple devices can be controlled by a single central controller using the individual channels to send control signals to connected addressable devices having their addresses set to specific ones of the channels.

Each device being controlled by the central controller has an electronic circuit which can interpret control signals. Each light dimmer has an electronic address which is set and is preferably unique to that device. The electronic address setting determines which of the individual channels of control information the device will take instructions from, while ignoring instructions on other channels.

Previously, the electronic address of addressable light dimmers and devices has been set using manual DIP switches on an exterior panel. Thus, once the device is positioned or mounted on a stage set, its address may not be easily changed if access to the device is restricted.

According to the invention, the electronic address for each device can be set electronically using a combination of keypress commands and a control signal from the central controller. The keypress commands, which may be made manually on the controllable devices or with a remote control, instruct the selected devices to enter an address set, or programming, mode.

Then, all of the control channels except for the channel that will address the device are set to zero amplitude level. That is, to set the address of the device to 30, a central controller channel 30 is the only channel not set to zero. The lone non-zero channel level is set to any non-zero level, preferably at least above a threshold level, $V_t$. The controller serially sends the signals for each channel to every connected controllable device. The device in address set mode decodes each channel signal and identifies the single non-zero level channel, which it then stores in a non-volatile memory, setting the address of the device to the non-zero level channel. Each device can then be returned to normal operation mode by operation of the remote or local keys on the device.

In a case where the addressable device uses more than one channel, the non-zero level channel sets the base address, and the additional channels used by the device are set as the next sequentially higher channel from the base address channel.

Alternatively, in addition to setting an address channel for the connected devices, peak and minimum limits, and other preset values, such as initial system states can be programmed with the address. The limits or preset values can be programmed using specific blocks of controller channels, or using channels following the non-zero channel setting the address. The addressable devices contain circuitry and software needed to store and interpret the signals received from the controller.

Thus, using the invention, several addressable devices can be positioned or mounted, as on a theater stage and using a combination of remote controls and the a controller, such as a DMX-512 controller, the addresses and preset limits of the devices may be set easily from a distance without disturbing their positioning.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 3 is a perspective view of a remote control used with the invention;

FIG. 4 is a perspective view of one type of addressable control device used with the invention;

FIG. 5 is a graphical depiction of the output of a DMX-512 protocol controller when setting an address of one of the addressable control devices;

DESCRIPTION OF THE PREFERRED EMBODIMENTS

Figure 1:
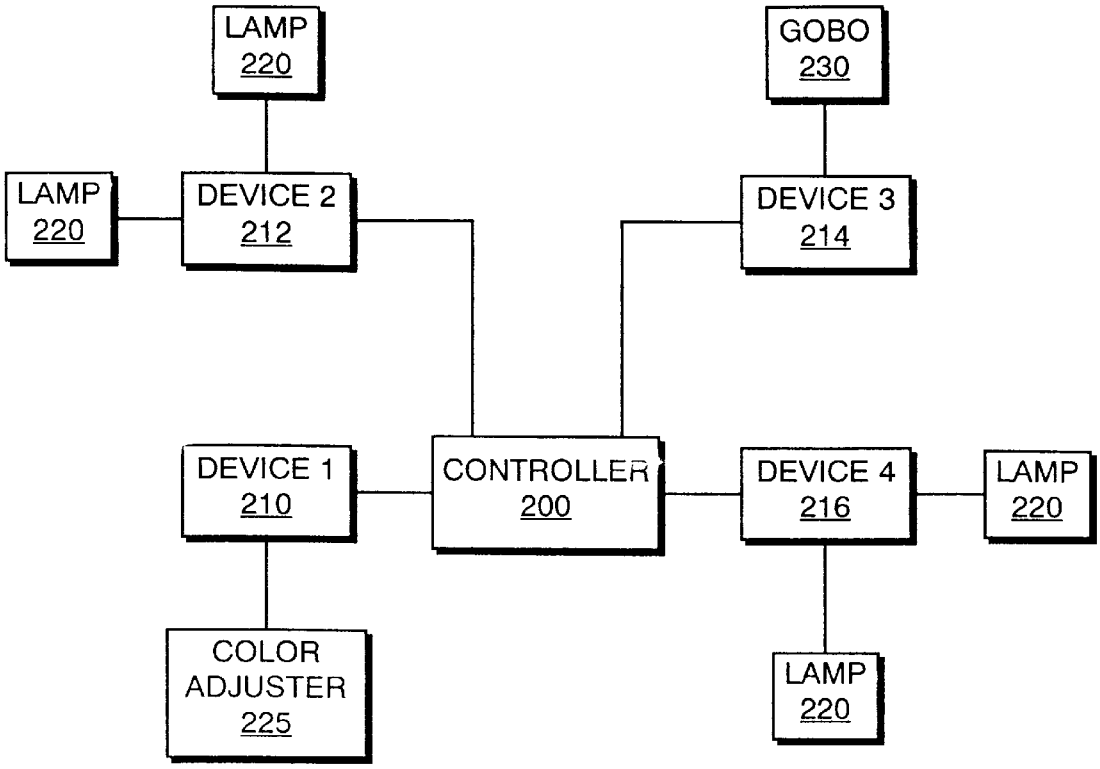
FIG. 1 is a schematic representation of the layout of a control system of the type used in the invention.

Referring now to the drawings, in which like reference numerals are used to refer to the same or similar elements, FIG. 1 shows a schematic depiction of a lighting system using a central controller 200, which may be a DMX-512 protocol controller, to coordinate and set the values of each of several addressable control devices 210, 212, 214, 216.

The DMX-512 protocol used in a DMX-512 protocol controller is described in a United States Theatre Technology, Inc. (USITT) publication entitled, "DMX512/1990 Digital Data Transmission Standard for Dimmers and Controllers." The protocol is a network protocol having a central controller for creating stream of network data consisting of sequential data packets. Each packet initially contains a header for checking compliance with the standard and synchronizing the beginning of data transmission, which is then discarded. A stream of sequential data bytes representing data for sequentially addressed device follows the header. For example, if the data packet contains information for device number 31, then the first 30 bytes after the header in the data stream will be discarded by device number 31 and byte 31 will be saved and used. When more than one byte of information is needed by a device, then its device number is its starting address and the number of required bytes after the starting address will be saved and used. The DMX-512 protocol uses a data stream of up to 512 bytes each having hexadecimal values corresponding to decimal numbers from 0–255.

Other serial control systems can be used for central controller 200 as well, such as a computer having a serial network link to each connected control device 210–216 to provide serial data commands. As used herein, it should be understood that such a serial controller could be substituted for a DMX-type controller.

The addressable control devices 210–216 each convert an information signal from one or more of the DMX-512 controller 200 channels into a usable signal for one or more attached lighting elements such as lamps 220, color adjustors 225 or gobo wheels 230, for example. Thus, the addressable control devices 210–216 could be dimmers or other types of control devices used in theatrical lighting. The addressable control devices 210–216 include circuits for setting the electronic address that determines which channel or base channel in the signal from the DMX-512 controller 200 is received and interpreted by the addressable control devices 210–216.

As discussed above, known DMX-512 controllers have up to 512 channels, each of which can transmit a different amplitude level. The amplitude level on each channel can be set to one of up to 255 discrete levels, with zero as the lower bound. The present invention takes advantage of the fact that the amplitude signal of each channel can be set individually and independently of the other channels combined with the fact that the signal from each channel is always transmitted serially in the same order at a constant rate with constant period in a repeating manner. That is, all 512 channels are continuously broadcast from the controller in series starting with channel 1, like a clock pulse train having different amplitudes.

Figure 2:
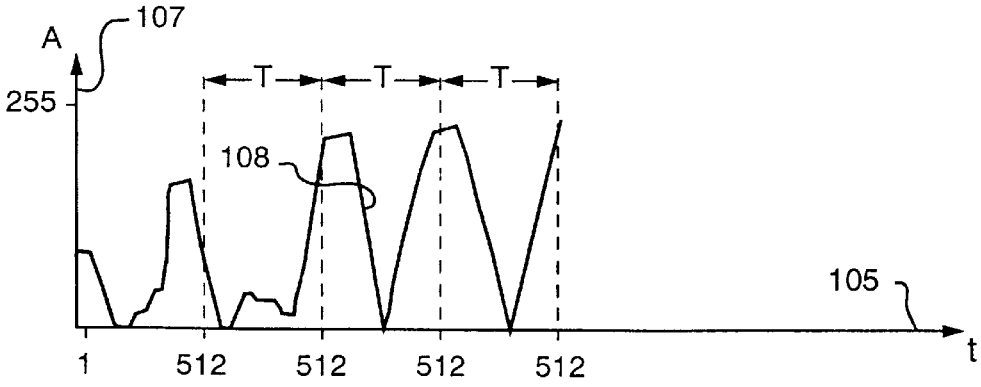
FIG. 2 is a graphical depiction of a signal generated by a DMX-512 protocol controller.

FIG. 2 shows a sample output signal 108 from a DMX-512 protocol controller having 512 channels. Relative time is shown along the x-axis 105 and analog amplitude is shown on the y-axis 107. The time at which the $512^{th}$ channel is broadcast is marked along the time axis 105 to show the repeating nature of the signal 108. As can be seen, a fixed time period T passes between each broadcast of the $512^{th}$ channel. Each of the 512 channels is broadcast sequentially during the time t encompassed by the period T. Depending on the length of period T and changes made at the DMX-512 controller, the signal 108 may repeat several times before changing, or it may change in the next cycle.

FIGS. 3 and 4 illustrate generally an addressable control device 210 and a remote control unit 90 that can be used with the invention.

The addressable control device 210 has a button panel 50 with a series of control buttons 51–55 and an LED indicator 56. The control buttons 51–55 are used to operate the device 210 to manually control a connected element, such as a lamp. For example, the buttons 51–55 may be part of a dimmer control circuit and include level up and level down buttons, preset level buttons and a power switch. For use with the invention, at least one combination of button presses can be used to switch an address circuit inside the device between an operating mode and a programming mode. For example, if both buttons 51 and 52 are held down simultaneously, the control device 210 will switch modes. The LED indicator 56 can be used to indicate when a button has been pressed and when the mode has been changed, such as by blinking repeatedly while in the programming mode.

A power connection 80, control cable 70 and infrared sensor 60 are provided on the control device 210. The control cable 70 is used to receive signals from the DMX-512 controller 200. Power connection 80 can be used to connect a controlled lighting element. The lighting element can be controlled by varying the power output to the element. Infrared sensor 60 is used to receive signals from the remote control 90.

The remote control 90 includes buttons 91–95 which correspond to the same functions as are found on the control device 210. The remote control 90 can be used to change settings on the control device 210 from a distance, thereby eliminating the need to be in physical proximity to the control device 210 to switch to the programming mode from the operating mode, for example.

Additional infrared sensors can be provided on the control device 210 so that at least one sensor is capable of receiving signals from remote control 90 when the addressable control device 210 is positioned above a theater stage for use in a lighting arrangement. Preferably, the LED indicator 56 is visible to provide visual confirmation that signals sent from the remote control 90 are received by the addressable control device 210.

The addressable control device 210 has the address circuit inside which is used to set and change the electronic address of the device. The electronic address of the control device 210 is the channel or base channel of the signal sent by the DMX-512 controller 200 that the control device 210 will take instructions on during operation. The control device 210 may have a base address when multiple channels are used to operate the control device 210. In such a case, the electronic address is set to the lowest number channel that information will be broadcast on. The control device 210 will then take information from the signal broadcast by the DMX-512 controller on the base channel and each sequential channel after the base channel to obtain the full signal needed to operate the control device 210. An example of how the electronic address of the control device 210 can be set is as follows.

All connected control devices 210–216 which will have the same electronic address are switched into the programming mode either using the buttons 51–55 on the control devices 210–216 themselves, or the remote control 90. The DMX-512 controller 200 is set so that all of the channels have amplitude levels of zero, except for the channel which corresponds to the electronic address the control device 210 will be set to.

FIG. 5 is an illustration of one possible signal sent by a DMX-512 controller 200 to one or more addressable control devices 210–216 connected to the controller 200 to set the electronic address of whichever devices are in the programming mode. The amplitude level of the signal 108 is shown on the y-axis 107 versus time on the x-axis 103. The graph shows the amplitude level 108 of each channel as the amplitude level of all 512 channels is sent sequentially in time t during period T. All of the channels 150 are set to zero level 110, except for channel 9, which is set to any non-zero amplitude level 100 greater than $V_t$. The control signal 108 is then sent to the connected devices 210–216, which receive the repeating signal of period T and interpret the amplitude level of each channel 150. The electronic address of any control devices 21–216 in the programming mode will be set to the non-zero level channel.

Thus, in this example, the electronic addresses of any connected control devices 210–216 which are in the programming mode will be set to channel 9. If the connected control device 210–216 in programming mode is a multi-channel device, the base address will be set to channel 9, and channels 10, 11, 12, etc. will be used in sequence for the remaining channels by the control device.

Once the DMX-512 control signal 108 has been sent while the control devices 210–216 are in the programming mode, the signal 108 can be terminated and the control devices 210–216 switched back to operating mode. A different electronic address can then be set for other control devices 210–216.

Alternatively, the DMX-512 controller 200 amplitude levels for each channel can be set first, followed by placing the appropriate control devices 210–216 in programming mode. Clearly, the controller signal 108 for setting the electronic address should be terminated or the control devices 210–216 taken out of programming mode before changing settings during programming to avoid errors.

Figure 6:
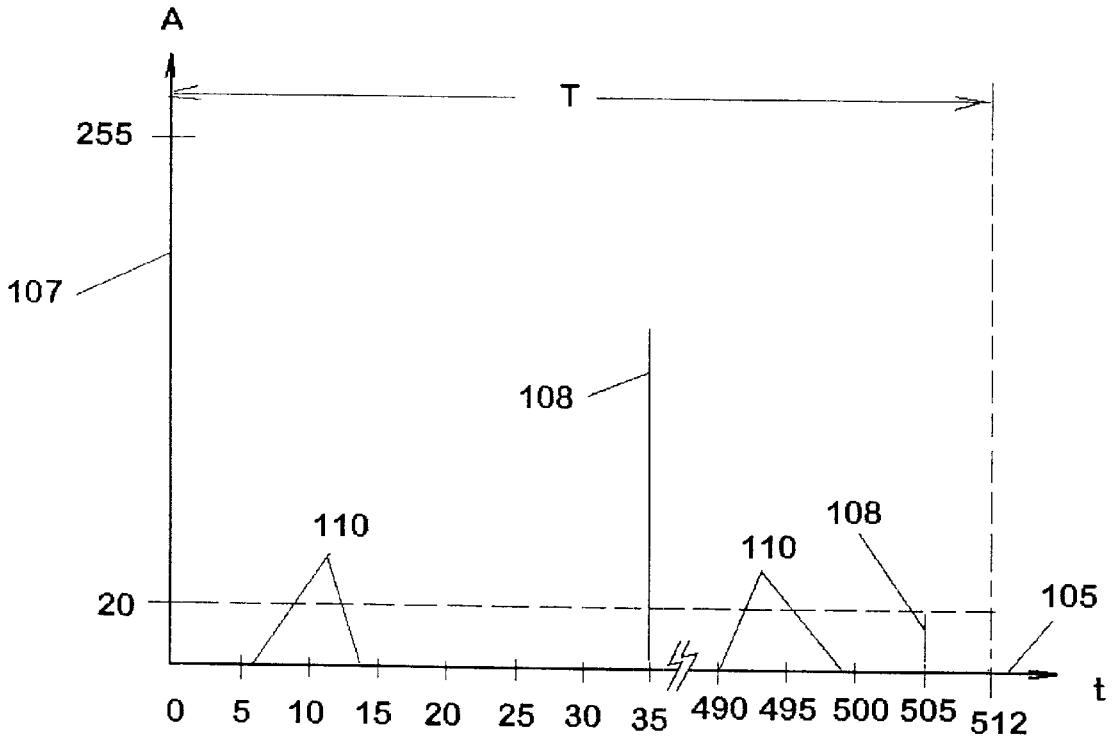
FIG. 6 is a graphical depiction of the output of a DMX-512 protocol controller used to set the address and a device feature limit.
Figure 7:
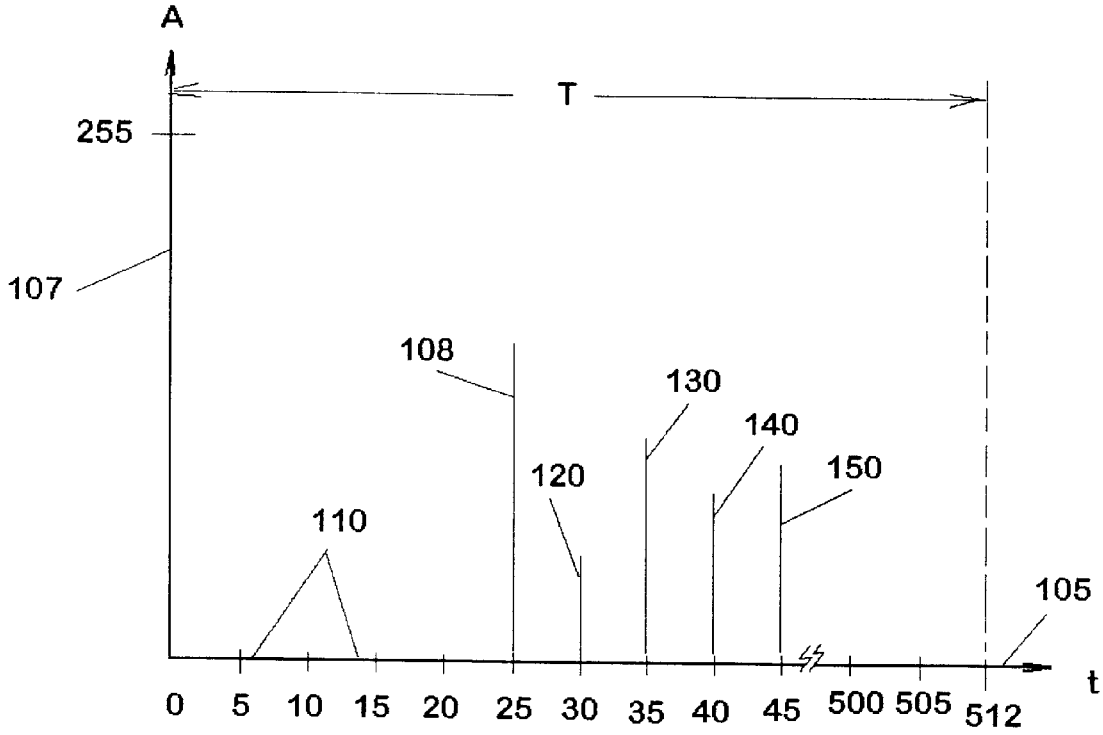
FIG. 7 is a graphical depiction of an alternative output of a DMX-512 protocol controller used to set the address and a device feature limit.

In a further embodiment of the addressing system, as shown in FIGS. 6 and 7, in addition to setting an address for a connected control device 210–216, the controller 200 can be used to set peak and minimum limit or preset levels, collectively referred to as preset levels, in the control devices 210–216.

Figure 8:
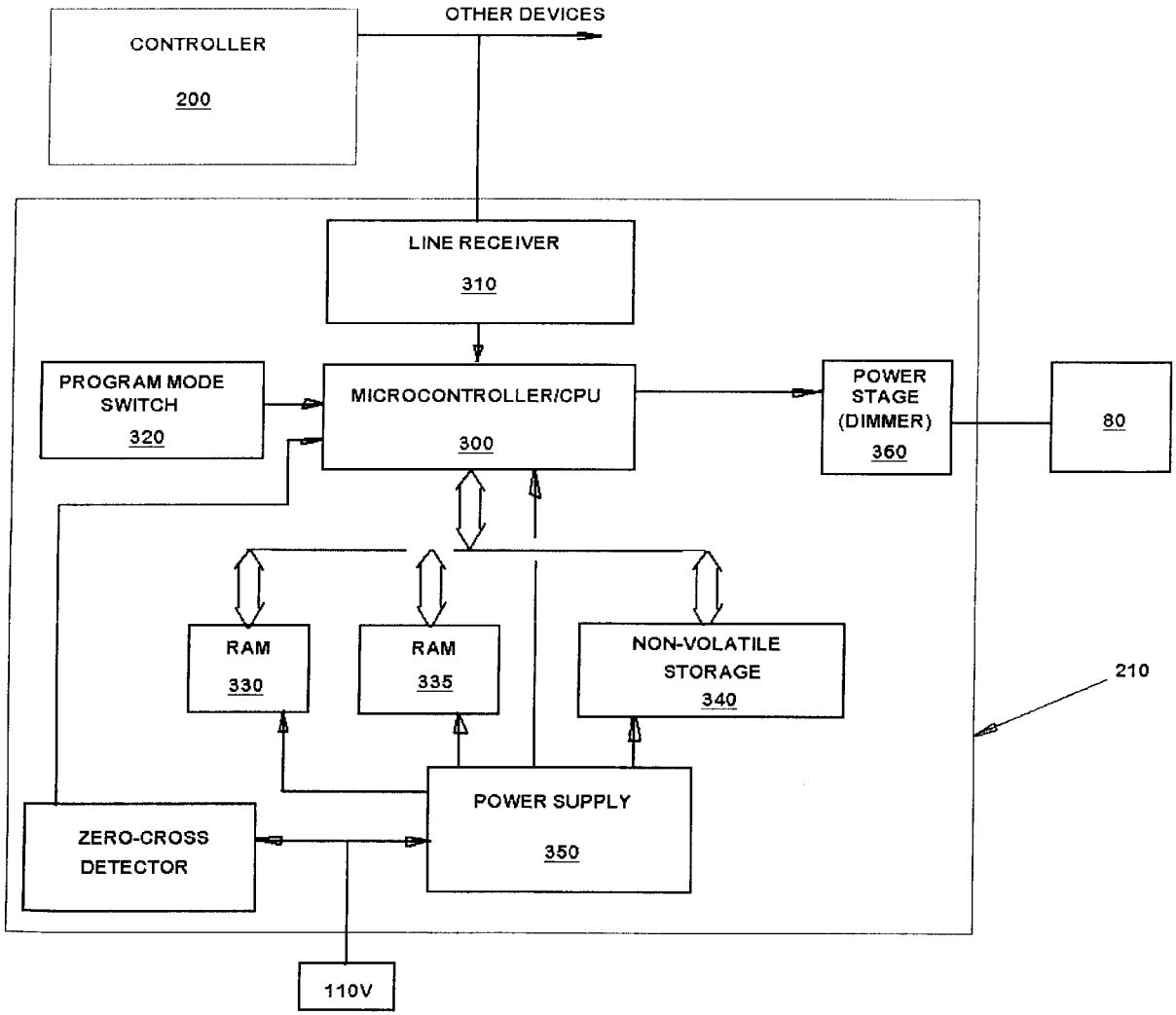
FIG. 8 is a schematic block diagram of an addressable device used with the invention.

The control devices 210–216 must be capable of interpreting a signal received on a predefined channel while in the programming mode as being a preset value for a particular function. As seen in FIG. 8, the control device 210 contains a micro-controller 300 having software or which is hardwired with logic programming for this purpose. To store information and facilitate the operation of the micro-controller 300, RAM 330, ROM 335 and non-volatile storage 340 are connected to the micro-controller via a bi-directional bus. Each of these components is powered by an internal power supply 350 connected to a wall outlet, a battery, a generator or other power source. A program mode switch 320 that is activated as described above is connected to the micro-controller 300. A line receiver 310 connects the micro-controller 300 to the network cabling 70 delivering signals from the central controller 200. Finally, a power stage 360 receives control signals from the micro-controller 300 and varies the power output to outlet 80 depending on the micro-controller 300 instructions.

In one embodiment of setting the address and preset levels, when a DMX-512 controller is used, for example, the channels from 502-512 may be set aside from use as a device address channel, and instead, are used to transmit preset values to control devices 210–216 at the same time as the address channel is set. A preset value transmitted on one of the channels in the upper-most 10-channel block is interpreted by the control device 210–216 as corresponding to a specific feature and is stored in programmable, non-volatile memory 340. The specific feature having the preset value set could be a minimum or maximum dimming/brightness level, another feature depending on percent power output of the control device 210–216, or a maximum shutdown temperature (control device turns off when operating temperature is higher).

As an example, the lighting system of the invention can be used in a large restaurant with several rooms each having different lighting requirements and thus requiring several control devices 210–216. As the addresses for the control devices 210–216 in each room are set, a minimum brightness level of 20% could be programmed as well, so that the room can never be made entirely dark accidentally.

FIG. 6 illustrates the output signal from a DMX-512 controller 200 to produce this result. The minimum brightness level can be set by first designating a channel as the control device address, such as channel 35, and transmitting a non-zero signal above $V_t$, followed by transmitting an amplitude of "20" on channel 505 as the control signal 108. The micro-controller 300 in the control device 210 is programmed to understand that the amplitude of the signal received on channel 505 corresponds to a minimum level of 20% and stores the value in a non-volatile memory 340. The remaining channels receive a zero-level signal 110 which is below $V_t$. When necessary to ensure that all intended signals are above $V_t$, the preset instruction amplitudes may be scaled, such as by addition of a constant value, or by a multiplier.

Following programming, while it is in the operating mode, the micro-controller 300 in control device 210 will compare any brightness command received on channel 35 (the control channel) to the 20% preset level stored in memory. If the received command is for a lower brightness percentage, it will be ignored as it is below the preset limit.

As a second example, a theater using the lighting system with a DMX-512 controller might want to limit certain lights from ever being dimmer than 10% brightness, brighter than 80% and having a temperature shutoff at 200° F. The control devices 210–216 for the lights in this group are each placed in program mode, as described above.

An address channel is selected, for instance, channel 25, and the channel amplitude is set to a non-zero value, while the remaining channels from 1 to 411 are all zero value amplitude. Channel 412 corresponding to minimum brightness is set to an amplitude of "10", channel 452 corresponding to maximum brightness is set to an amplitude of "80", and channel 502 corresponding to the shutoff temperature is set to an amplitude of "100". The control devices 210–216 receive the non-zero signal on channel 25 and each sets the address for the device as channel 25. Then the devices 210–216 receive the amplitude value of "10" on channel 412 and set a minimum brightness level of 10% in a programmable non-volatile memory 340. A maximum brightness level of 80% is stored in the memory 340 after the signal on channel 452 is received. The amplitude of "100" received on channel 502 is scaled by a factor of two in accordance with programming in the control devices 210–216 to correspond to the shutoff temperature of 200° F. and the value is stored in memory 340.

In a further alternative, illustrated by the control signal 108 shown in FIG. 7, the control devices 210–216 may contain software or other logic programming for understanding that the first non-zero level above $V_t$ received in the program mode is the base channel, and that any subsequent non-zero level sets one or more preset values for predefined features. For example, if channel 25 is the desired address for the control device 210, then channels 1–24 will have a zero amplitude and channel 25 will have a non-zero amplitude of any level higher than $V_t$ to indicate it is the address channel. Then, any subsequent channel, from 26–516 in a DMX-512 system, can contain preset value information.

The preset values can be set based on the order in which they are received when more than one value will be set. The control devices 210–216 understand that the first value after the address channel corresponds to one feature, and then the next channel in sequence corresponds to a second feature, followed by the next channel containing information corresponding to a third feature and so on. The preset value setting channels could be spaced by any number of channels to make setting the values easier or reduce errors, if necessary. For example, the micro-controller 300 may contain programming which determines that after the address channel is set, five channels later (channel 30 in the example) contains a minimum brightness setting 120, while another five channels later contains a maximum brightness setting signal 130, five channels after than is an initial state (power on) brightness setting signal 140 and five channels later is an overheat shutdown temperature setting (channel 45) signal 140. Thus, a value does not have to be preset for each feature as the amplitude value of the signal 108 on that channel could be left below $V_t$, so that the micro-controller 300 will not interpret that channel as containing any information.

In each of the alternative programming situations described above, the control devices 210–216 require a micro-controller 300 or other logic device and software instructions used in the programming mode to evaluate the signals coming from the controller 200. The software contains information either about which channels are blocked off and correspond to preset value settings, or understands that subsequent non-zero values are preset value settings.

Although the invention is described using a DMX-512 protocol controller to generate the address programming signal, it is possible to use another networking protocol controller having similar features. As noted above, a feature of the DMX-512 protocol which makes it usable for this purpose is the repeating, periodic nature of the serial output signal, which permits the addressable control devices to determine which channel has a non-zero amplitude level when in the programming mode. Thus, another serial transmitting controller having a plurality of channels could be used if the channel amplitude levels are transmitted sequentially in a periodic repeating pattern.

Further, the invention could be used with other types of control systems other than theater lighting systems. For example, the control system is easily adaptable to a variety of architectural lighting, such as for building interiors, building exteriors and home interior design. The control system and addressable devices are also very useful for lighted sign applications, where a complex sign display may require changing different settings to produce a display. The system can be used with neon, other gas discharge, incandescent, and fluorescent lighting schemes.

The invention is ideal for any situation where a central controller is used to operate individual control devices where rapid changing of addresses of the control devices is desired. A clear advantage of the invention over the prior art devices is the ease with which the address or other preset values for each control device connected to the controller can be changed without dismounting or removing the control device from its location.

While a specific embodiment of the invention has been shown and described in detail to illustrate the application of the principles of the invention, it will be understood that the invention may be embodied otherwise without departing from such principles.

What is claimed is:

1. A control system, comprising:

a controller having an output signal composed of a plurality of channels transmitted repeatedly in sequence, in a set period, an amplitude level of each channel being set independently of the other channels;

a plurality of addressable control devices, each addressable control device being connected to the controller and corresponding to at least one of the channels, each addressable control device having a changeable electronic address and a changeable preset feature having a preset value, switch means for switching between a program mode and an operation mode a plurality of times for remotely changing the address or the preset value of each addressable control device a plurality of times, each addressable control device being in its program mode when its address or the preset value is changed, receiving means for receiving the output signal of the controller, the electronic address of each addressable control device being set by the output signal when the addressable control device is in the program mode, the amplitude level for one of the channels of the output signal being set to a non-zero level, the non-zero level channel corresponding to an addressable control device which is in its program mode, the amplitude level for the channels corresponding to the other addressable control devices being zero and preset means for setting the preset value of the preset feature when the electronic address is set.

2. A control system according to claim 1, further comprising remote control means for operating the switch means between the program mode and operation mode.

3. A control system according to claim 1, further comprising indicating means for indicating when the addressable control device is in the program mode.

4. A control system according to claim 1, wherein the electronic address is a base address corresponding to the lowest channel of at least two channels of the output signal the addressable control device receives data from.

5. A control system according to claim 1, wherein the controller and at least one control device are part of one of a theater lighting system, architectural lighting and signage.

6. A control system according to claim 1, wherein the controller is a DMX-512 protocol controller.

7. A control system according to claim 6, wherein the controller and at least one control device are part of one of a theater lighting system, architectural lighting and signage.

8. A control system according to claim 1, wherein at least one channel of the plurality of channels is designated a preset channel and the preset means comprises micro-controller means in each addressable device for evaluating and determining if the preset channel is a non-zero level amplitude and setting the preset value of the preset feature according to the amplitude level received on the preset channel.

9. A control system according to claim 8, wherein the preset channel comprises the highest channel output by the controller.

10. A control system according to claim 8, wherein the preset channel comprises a plurality of preset channels.

11. A control system according to claim 10, wherein the plurality of preset channel comprise the highest channels output by the controller.

12. A control system according to claim 11, wherein the controller is a DMX-512 protocol controller.

13. A control system according to claim 8, wherein the preset channel is designated by being the next channel to have a non-zero amplitude following the electronic address.

14. A control system according to claim 13, wherein the preset channel comprises a plurality of preset channels.

15. A control system according to claim 14, wherein the plurality of preset channels have a fixed number of output signal channels between preset channels.

16. A control system according to claim 15, wherein the controller is a DMX-512 protocol controller.

17. A method of programming addresses of addressable control devices in a lighting control system having a controller connected to the addressable control devices, the method comprising:

providing a plurality of addressable control devices, each addressable control device having at least one changeable preset feature, each preset feature having a range of preset values, each addressable control device having a programming mode and an operating mode and being switchable to the programming mode a plurality of times for remotely changing an electronic address and at least one preset value of each addressable control device a plurality of times, each addressable control device being in its program mode when its address and at least one preset value is changed, address means for setting and storing the electronic address for each addressable control device and preset means for setting and storing one preset value in the range of preset values for the at least one preset feature of the addressable control device;

placing at least one addressable control device in the programming mode;

providing a controller producing an output signal composed of a plurality of channels, each channel having an amplitude level which is set independently of the other channels, the plurality of channels being transmitted repeatedly in sequence in a fixed period;

designating a plurality of the plurality of channels as address channels, each addressable control device corresponding to at least one of the channels;

designating the remainder of the plurality of channels as preset channels, each at least one preset feature corresponding to one preset channel;

setting all of the address channels of the controller output signal to zero amplitude level, except for one address channel which is set to any non-zero amplitude level;

setting at least one of the preset channels to a preset non-zero amplitude level representing one of the range of preset values for the corresponding preset feature, the remaining preset channels being set to a zero amplitude level;

transmitting the output signal to the addressable control devices in programming mode, the address means receiving the output signal and determining which channel of the plurality of address channels is a non-zero amplitude level channel and setting the electronic address of the addressable control device to the non-zero amplitude level channel, the preset means receiving the output signal and determining and setting each preset feature to the one of the range of preset values represented by the preset non-zero amplitude level.

18. A method according to claim 17, further comprising switching the at least one addressable control device to the operating mode.

19. A method according to claim 17, wherein at least the placing the at least one addressable control device in programming mode is done from a physically remote location from the control device.

20. A method according to claim 17, further comprising mounting the at least one addressable control device in a physically remote location from the controller.

21. A method according to claim 20, wherein the at least one addressable control device is placed in programming mode using a remote control.

22. A method according to claim 17, wherein the controller is a DMX-512 protocol controller.

23. A method according to claim 22, further comprising mounting the at least one addressable control device in a physically remote location from the DMX-512 protocol controller.

24. A method according to claim 23, wherein the placing the at least one addressable control device in programming mode is done using a remote control.

25. An addressable control device for use with a control system that generates an output signal composed of a plurality of channels repeatedly transmitted serially in a fixed period, each channel having an amplitude level which is set independently of the other channels, the addressable control device comprising:

a housing;

signal means for receiving the output signal in the housing;

mode means for switching between a programming mode and an operating mode in the housing a plurality of times and each time an electronic address of the housing is to be changed;

addressing means for electronically setting and storing an electronic address corresponding to one of the plurality of channels in the output signal received by the signal means, the electronic address being set in the programming mode to the first on e of the plurality of channels received in the output signal that has a first non-zero amplitude level; and preset means for electronically setting and storing a preset value for a preset feature using a second one of the plurality of channels having a preset amplitude level, the preset value corresponding to the preset amplitude level.

26. A device according to claim 25, wherein the mode means comprises at least one button on the housing and a circuit means for switching between modes when the at least one button is depressed.

27. A device according to claim 26, further comprising a remote control for activating the circuit means from a physically remote location from the housing.

28. A device according to claim 25, further comprising a remote control for activating the mode means from a physically remote location from the housing.

29. A device according to claim 25, further comprising sensor means for receiving remotely transmitted signals for operating the mode means.

30. A control device according to claim 25, wherein the second channel having the preset amplitude level is received later in time than the first channel.

31. A control device according to claim 30, wherein t he preset amplitude level is a non-zero amplitude.

32. A control device according to claim 30, wherein the preset amplitude level is scaled to a range of preset value s for the preset feature.

33. A control device according to claim 25, wherein the preset means comprises logic means for setting and storing a plurality of preset values, each preset value corresponding to one of a plurality of preset features, the setting and storing being accomplished by the logic means receiving a plurality of preset channels of the output signal, each having a preset amplitude level, after receiving the first channel and correlating each preset amplitude level of the plurality of preset channels to one of the plurality of preset features.

34. A control device according to claim 33, wherein at least some of the preset amplitude levels are non-zero amplitude levels.

35. A control device according to claim 33, wherein the preset channels are designated as the highest n channels of the output signal, where n is equal to the number of preset features.

36. A control device according to claim 33 wherein the first preset channel follows the first channel having the first non-zero amplitude level by a first fixed number of channels and each subsequent preset channel after the first preset channel follows the immediately prior preset channel by a second fixed number of channels in the output signal.

* * * * *